US006749071B2

(12) United States Patent
Caterinacci

(10) Patent No.: US 6,749,071 B2
(45) Date of Patent: Jun. 15, 2004

(54) MERCHANDIZING DISPLAY

(75) Inventor: John Caterinacci, Hudson, OH (US)

(73) Assignee: American Greetings Corporation, Cleveland, OH (US)

( * ) Notice: Subject to any disclaimer, the term of this patent is extended or adjusted under 35 U.S.C. 154(b) by 218 days.

(21) Appl. No.: 10/016,160

(22) Filed: Dec. 10, 2001

(65) Prior Publication Data

US 2003/0106867 A1 Jun. 12, 2003

(51) Int. Cl.[7] ..... A47F 5/00
(52) U.S. Cl. ..... 211/40; 211/59.3; 312/71
(58) Field of Search ..... 211/51, 59.3, 40; 312/71

(56) References Cited

U.S. PATENT DOCUMENTS

| | | | | | |
|---|---|---|---|---|---|
| 877,671 | A | * | 1/1908 | Simmons | |
| 2,927,699 | A | * | 3/1960 | McGraw | 211/51 |
| 3,224,822 | A | * | 12/1965 | Kirby | 312/71 |
| 3,357,597 | A | * | 12/1967 | Groff | |
| 4,588,093 | A | | 5/1986 | Field | |
| 4,887,737 | A | * | 12/1989 | Adenau | 312/71 X |
| 5,123,544 | A | * | 6/1992 | Hannecke | 211/51 |
| 5,449,076 | A | * | 9/1995 | Van Noord | 211/59.3 |
| 5,665,304 | A | * | 9/1997 | Heinen et al. | 312/71 |
| 5,813,569 | A | * | 9/1998 | Cihanek | 312/71 X |
| 5,996,815 | A | | 12/1999 | Walters et al. | |
| 6,006,927 | A | * | 12/1999 | Levy | 211/51 |
| 6,155,435 | A | | 12/2000 | Malik | |
| 6,164,461 | A | | 12/2000 | Ward et al. | |
| 6,196,510 | B1 | | 3/2001 | Legaspi | |
| 6,209,730 | B1 | | 4/2001 | Ewing | |

* cited by examiner

*Primary Examiner*—Robert W. Gibson, Jr.
(74) *Attorney, Agent, or Firm*—Roetzel & Andress

(57) ABSTRACT

A merchandise display device for dispensing and displaying digital media cases. Digital media cases are inserted vertically into the opening between the front panel and the lateral supports. This opening limits the number of cases which can be removed and/or inserted at one time. The width of the opening allows only two cases to be inserted or removed at a time, to deter theft. The opening, however, still allows for easy access when removing or inserting the cases. A replaceable pusher is attached to the back wall of the unit to bias the digital media cases toward the front panel. The display units are broken into two separate components, a right and left side. The components allow for flexibility in arranging the display system, depending on the need of the vendor. The invention provides a storage display system which continuously maintains the organized orientation of digital media cases, displays the covers of these cases, permits easy access and use of the stored objects and allows for flexibility so that the storage units are easy to install, reconfigure, and remove.

8 Claims, 2 Drawing Sheets

MERCHANDIZING DISPLAY

FIELD OF THE INVENTION

The present invention pertains generally to a device for displaying and storing merchandise and, more particularly, to a merchandise display for digital media cases.

BACKGROUND OF THE INVENTION

As is well known, a variety of consumer goods are merchandised in display cases which typically comprise a drawer or shelf wherein the display merchandise is stacked in parallel rows within the drawer. As merchandise is selectively removed from the drawer, the stacks of merchandise often collapse rendering the merchandise unsightly for display purposes. This required sales personnel to continuously monitor the display cases to insure that the merchandise remained in an organized fashion. Additionally, these display devices were prone to theft. Merchandise could easily and quickly be taken. Thus, there is a need for a merchandise display device which is adapted to continuously maintain the organized orientation of merchandise positioned upon a display surface and deter theft.

Another problem is that the current storage units for compact disks (CD's), digital video disks (DVD's), and assorted video games are only suitable for storing vast quantities of such cases, and are not suitable for display. These storage units are designed to optimize storage capacity rather than to display. The cases are generally inserted vertically with one thin side being exposed to view. Because most storage and display apparatus show only the ends of the cases, consumers of music, movies and computer games have a difficult time searching through stacks of compact disks and DVD's to find their desired selection. Thus, there is a need for a storage system which optimizes storage capacity, as well as display. A storage unit which clearly displays the front side of the individual compact disks and DVD's, thus enabling the viewer to easily read the cover and make a selection.

Overall, a need arises for a storage display system which continuously maintains the organized orientation of DVD's, displays the covers of cases, permits easy access and use of the stored objects, provides low-cost storage display units, and allows for flexibility so that the storage units are easy to install, reconfigure, and remove.

SUMMARY OF THE INVENTION

The present invention, though functioning as a storage unit and storage system, focuses on and takes advantage of displaying the covers while permitting flexibility of storage configuration and capacity.

In one embodiment of the invention, the merchandise display unit comprises a tray with at least one side panel, a back panel, and a front panel. The back panel is taller than the front panel, however the side panels are the same height as the back panel. The side panels contain lateral supports positioned on the top of each side panel and extending toward the mid-line of the tray. The lateral supports prevent the digital media cases from being removed through the top of the storage unit. Further, a replaceable pusher is connected to the back panel of the tray. The pusher is used to advance the digital media cases toward the front panel of the tray for dispersement.

In another aspect of the invention, the side panels do not contain lateral supports positioned on the top of the side panels. The front panel, back panel, and side panels form a box-like structure, which is completely open on top. In this embodiment, digital media cases can be removed and inserted directly through the top of the display unit.

These and other aspects of the invention are herein described with reference to the accompanying Figures which are representative of just a few of the ways in which the principles and concepts of the invention can be embodied.

DETAILED DESCRIPTION OF THE INVENTION

The invention provides a merchandise display device for the dispensing and displaying of digital media cases. The present invention displays the covers of digital media cases, while permitting flexibility of storage configuration and capacity.

Figure 2:
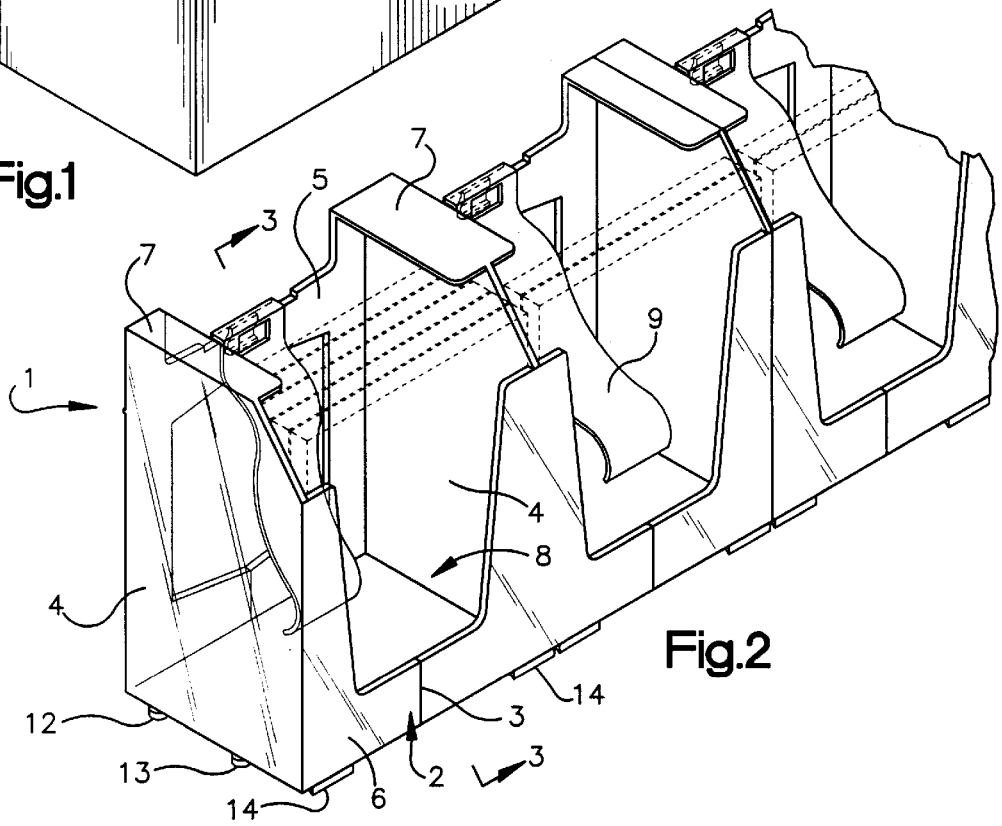
FIG. 2 is a perspective view of individual display units of the merchandising display system.

FIG. 2 illustrates the individual merchandise display units 1 of the present invention. Each merchandise display unit 1 is configured as a box-like structure, containing a tray 2 having at least one side panel 4, a back panel 5 and a front panel 6. The front panel 6 has a top edge 61. The back panel 5 of the display unit 1 is considerably taller than the front panel 6. Side panels 4, however, are the same height as the back panel 5. Additionally, front panel 6 contains an opening 8. The opening 8 extends the length of the front panel 6, allowing the covers of the digital media cases to be displayed. The edges of opening 8 act to retain the digital media cases and prevent them from falling out of the front of the display unit 1.

Next, the top of side panels 4 contain lateral supports 7. Lateral supports 7 extend inward toward the mid-line 3 of tray 2. The lateral supports 7 extend inward only a few inches, forming a lip on either side of the display unit 1, and have a front edge 71. The extension of the lateral supports 7 over the internal cavity of the display container blocks removal of merchandise packages, such as the digital media cases, upward through the top of the display unit 1.

Figure 3:
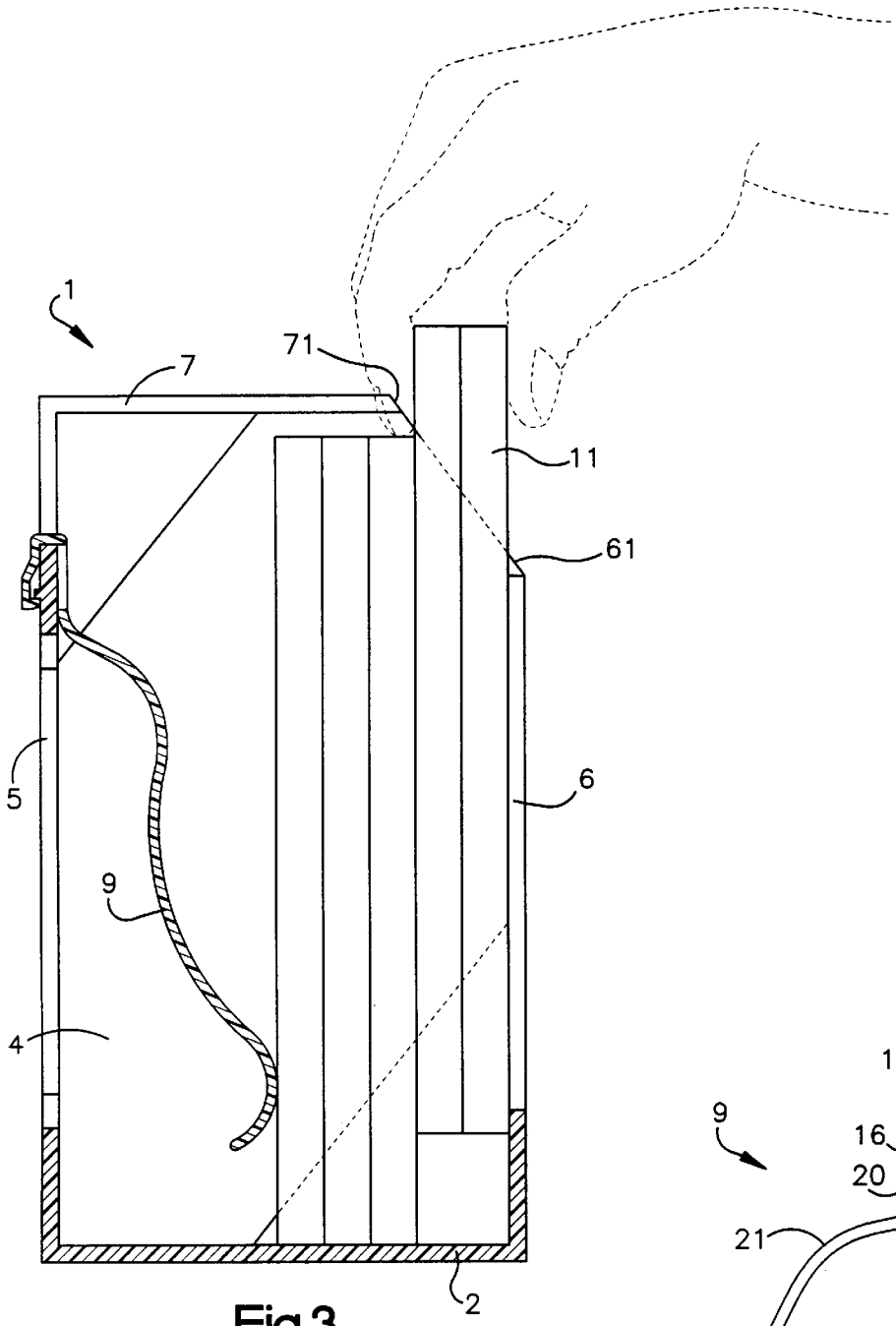
FIG. 3 is an elevation view of a single merchandising display unit of the present invention.

FIG. 3 illustrates how the digital media cases 11 are inserted into or removed from the display units. The front panel 6, terminating at edge 61, is shorter than side panels 4, leaving a small opening between front panel 6 and lateral supports 7. This opening limits the amount of space available for inserting or removing merchandise. Consequently, only a few packages, such as the digital media cases 11 can be loaded or removed at one time. The digital media cases 11 are loaded vertically between the top of front panel 6 and the lateral supports 7 and then slid towards the back panel 5. Edge 71 of the lateral supports 7 in combination with edge 61 of the front panel 6 defines the opening for passage of the merchandise packages, thereby deterring theft. Restricting the number of packages which can be removed at one time, requires a potential thief to expend more effort and time in removing all of the digital media cases. Thus, a potential thief would more likely not risk being caught by taking the extra time to remove all of the cases. However, the display unit 1 can still be easily and quickly re-stocked.

Figure 4:
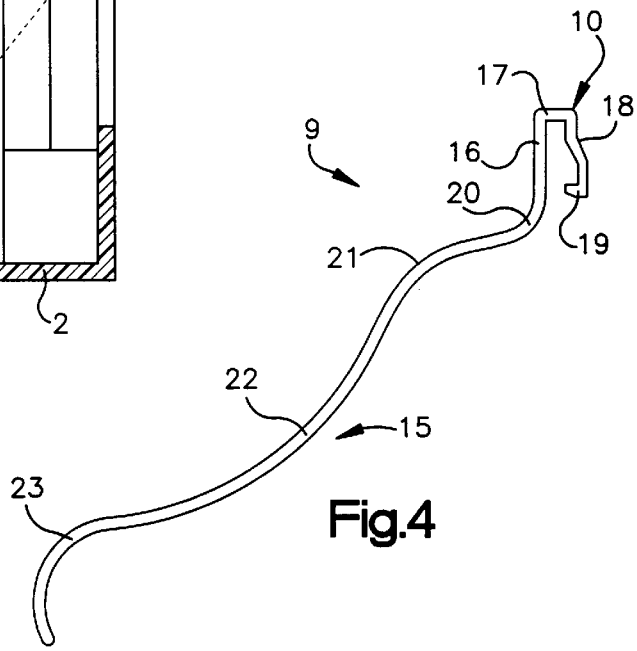
FIG. 4 is a side view of the replaceable pusher of the present invention.

FIG. 4 illustrates the replaceable pusher 9. Pusher 9 acts to bias the digital media cases towards the front panel 6. The pusher 9 is connected to the back panel 5 by a bent-over flange or clip 10. The bent-over flange or clip 10 comprises a first vertical segment 16, a curved segment 17, and a second vertical segment 18. An anchor member 19 is attached to the inside of the second vertical segment 18 to releasably anchor the pusher 9 to the back panel 5. This allows the pusher 9 to be removed and replaced. Therefore, when arranging components into the desired display system, pusher 9 can easily be removed when not needed. Additionally, pusher 9 is typically made out of plastic, such as polycarbonate. Therefore, in the present invention, pusher 9 also contains an elongated curved structure 15 attached to the bent-over flange or clip 10. The elongated curved structure 15 is comprised of a first curved segment 20 having a smaller radius than a second oppositely curved segment 21, a third curved segment 22 having a larger radius than both the first and second curved segments and curved opposite to the second curved segment 21, and a fourth curved segment 23 having approximately the same radius as the second curved segment 21 and curve opposite to the third curved segment 22. These gentle rolling curves prevents the plastic from losing its shape and passing its elastic limit. In another embodiment, the pusher 9 contains a ridge running lengthwise down it. This also acts to prevent the plastic from losing its shape.

Figure 1:
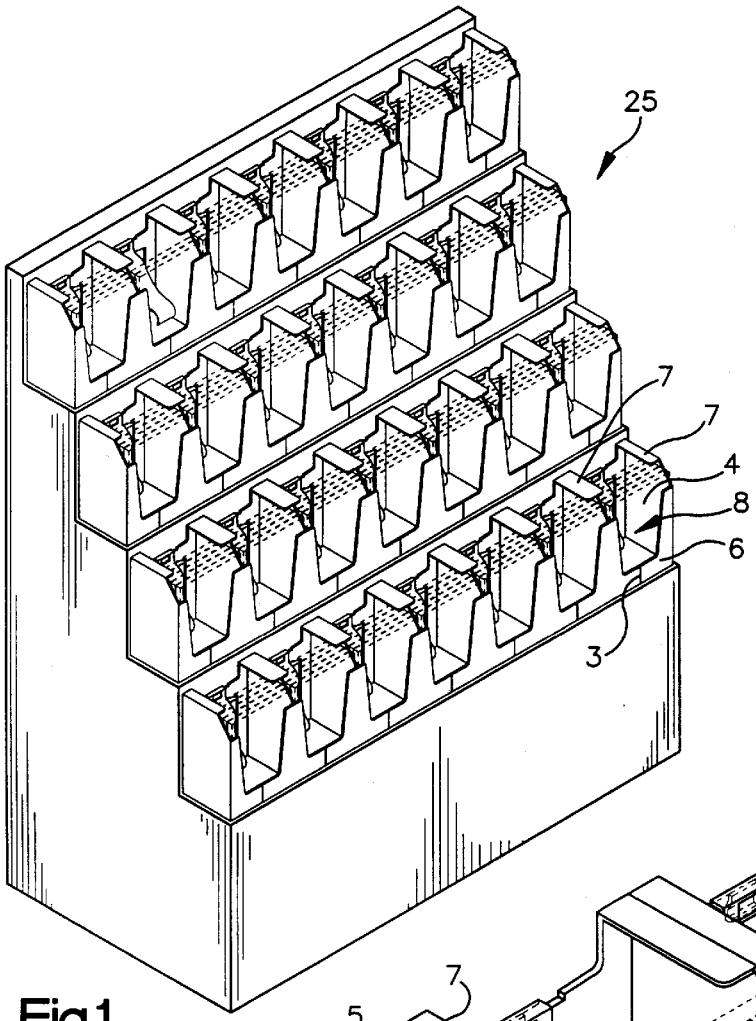
FIG. 1 is a perspective view of a merchandizing display system of the present invention.

FIG. 1 illustrates the merchandise display system 25 of the present invention. Here, the display units 1 are arranged in a standard display configuration. However, the display units 1 can easily be arranged in a variety of other display configurations. The tray 2 of the display unit 1 is divided equally down its mid-line 3, into right and left components. These separate components allow for flexibility of arrangement and storage capacity. Thus, the amount of display units 1 can easily be altered to accommodate more/less merchandise or they can be arranged in various display configurations, such as around a television set to aid in displaying DVD's.

FIG. 2 depicts the display unit 1 containing a pair of friction-reducing ridges 12 and 13. These ridges 12 and 13 are located on the underside of tray 2. The ridges 12 and 13 act to reduce the amount of friction on the display unit 1, as it is slid across the shelf. This is done by reducing the amount of surface area touching the shelf. Instead of the entire underside of tray 2 coming in contact with the surface of the shelf, only ridges 12 and 13 make contact with the surface of the shelf. Thus, the less surface area touching the shelf, the less friction, and the easier the display unit 1 will slide.

FIG. 2 also depicts the display unit 1 containing two pairs of tabs 14. These tabs 14 are located on the outside edges of the tray 2. One set of tabs 14 is located in the front of the tray 2, at opposite sides. And one set of tabs 14 is located in the back of the tray 2. These tabs 14 engage into the channels of the shelf, to lock the display unit 1 into place on the shelf.

Although the invention has been described in detail with respect to a preferred embodiment, it will be appreciated to those of skill in the art that certain modifications and variations of the inventive principles disclosed can be made. In particular, the tray 2 of the display unit 1 does not have to be divided equally down its mid-line 3 into a right and left side. The display units 1 can be left as a box-like structure. This, however, reduces the flexibility of arrangement and storage capacity.

What is claimed is:

1. In combination, a merchandizing display unit for displaying an article of merchandise, the combination comprising:

a) a tray having opposing side panels, a back panel, and a front panel, the back panel and the side panel being taller than the front panel, and a bottom panel;

b) a lateral support positioned on top of the side panel, the lateral support extending toward the mid-line of the tray, wherein the front, side and bottom panels, and the lateral supports define an internal volume dimensioned to receive the merchandise to be displayed, wherein the merchandise extends from one side panel to an opposing side panel;

c) an opening in the front panel, wherein the opening is less than a width of the merchandise;

d) an opening between the lateral supports, wherein the opening is less than a width of the merchandise; and e) a replaceable pusher connected to the back panel of the tray for advancing merchandise toward the front panel of the tray, wherein the replaceable pusher has a bent-over flange adapted to be attached to the back panel, wherein the bent-over flange comprises a first vertical segment, a curved segment, and a second vertical segment.

2. The display unit of claim 1, wherein the bent-over flange has an anchor member attached to the inside of the second vertical segment.

3. The display unit of claim 2 wherein the replaceable pusher further has an elongated curved structure attached to the bent-over flange, the elongated curved structure comprises a first curved segment having a smaller radius than a second oppositely curved segment, a third curved segment having a larger radius than both the first and second curved segments and curved opposite to the second curved segment, and a fourth curved segment having approximately the same radius as the second curved segment and curved opposite to the third curved segment.

4. The display unit of claim 3, wherein the replaceable pusher further has a rib running lengthwise down the middle.

5. The display unit of claim 1, wherein the tray is divided equally down a mid-line to form right and left components.

6. The display unit of claim 5, wherein the right and left components are equal in size.

7. The display unit of claim 1, wherein the bottom of the tray further comprises a pair of friction-reducing ridges.

8. The display unit of claim 7, wherein the bottom of the tray further comprises two pairs of tabs which engage into the channels of a shelf.

* * * * *